United States Patent [19]

Gualdoni

[11] Patent Number: 4,963,117

[45] Date of Patent: Oct. 16, 1990

[54] SELECTIVELY ILLUMINATED TOY BALL

[76] Inventor: Kevin G. Gualdoni, 16007 Bayham Dr., Mt. Clemens, Mich. 48044

[21] Appl. No.: 428,973

[22] Filed: Oct. 30, 1989

[51] Int. Cl.[5] ..... A63H 33/22; A63H 17/28; A63B 41/00

[52] U.S. Cl. ..... 446/219; 446/901; 446/438; 273/65 E; 273/65 F

[58] Field of Search ..... 446/219, 222, 224, 431, 446/437, 438, 439, 901; 273/58 F, 58 G, 58 A, 65 R, 65 E, 65 EF, 65 F, 415, 428, 65 C, 65 D, DIG. 24, DIG. 30

[56] References Cited

U.S. PATENT DOCUMENTS

| | | | |
|---|---|---|---|
| 3,111,317 | 11/1963 | Cituk | 273/428 X |
| 3,580,575 | 5/1971 | Speeth | 273/58 G |
| 4,002,893 | 1/1977 | Newcomb et al. | 273/65 R |
| 4,011,611 | 3/1977 | Lederman | 273/415 X |
| 4,015,111 | 3/1977 | Spector | 273/58 A X |
| 4,151,994 | 5/1979 | Stalberger | 273/415 X |
| 4,197,670 | 4/1980 | Cox | 446/901 X |
| 4,479,649 | 10/1984 | Newcomb et al. | 273/61 R |
| 4,586,456 | 5/1986 | Forward | 446/222 X |
| 4,701,146 | 10/1987 | Swenson | 446/439 X |
| 4,717,158 | 1/1988 | Pennisi | 273/DIG. 24 X |

FOREIGN PATENT DOCUMENTS

| | | | |
|---|---|---|---|
| 12653 | 7/1903 | Austria | 273/65 D |
| 375054 | 12/1923 | Fed. Rep. of Germany | 273/65 E |
| 2583648 | 12/1986 | France | 273/58 G |

*Primary Examiner*—Robert A. Hafer
*Assistant Examiner*—D. Neal Muir
*Attorney, Agent, or Firm*—Peter D. Keefe

[57] ABSTRACT

A footbag having a pliant outer skin made of a translucent plastic material. The interior of the footbag is filled with a plurality of translucent or fluorescent beads. An aperture is provided in the skin, the diameter of which permitting one chemical light stick, or if desired one or more chemical light sticks to be inserted into the footbag. Connected with the skin adjacent the aperture therein, and extending into the interior of the foot bag is a sack of generally cylindrical shape. The sack is translucent and receives the chemical light stick so that the beads are prevented from spilling out of the footbag through the aperture. A plurality attached flexible skin panel covers the aperture, and is secured, to the perimeter of the aperture, in those areas where it is not permanently attached, by a hook and loop type fastener.

9 Claims, 1 Drawing Sheet

SELECTIVELY ILLUMINATED TOY BALL

BACKGROUND OF THE INVENTION

1. Field of the Invention

The present invention relates to toy balls, and more particularly relates to toy balls having incorporated therein an illumination device for viewing the ball when play is engaged during nocturnal hours. The present invention is still more particularly related to balls in the form of footbags, in which the footbag is provided with an illumination system.

2. Description of the Prior Art

Balls are particularly well suited to a great many different kinds of games and sports. Of course, balls for particular games and sports are shaped, textured and weighted differently as that application best suits. In any event, play is generally confined to those hours of the day when sufficient light is available to clearly see the ball; otherwise, a lighted playing field is required.

One class of balls that is of particular concern to the present invention is a footbag. An example of a footbag is the HACKY SACK, which is a registered trademark of Wham-O Corporation, described in U.S. Pat. No. 4,151,994. Footbags are generally constructed of an outer leather casing having a diameter of about three inches, which is filled with small bead material. This construction results in the footbag having a pliant but non-resilient response to contact with objects, in particular the players' feet.

In the prior art there have been attempts at providing an internal illumination device for a ball. Examples of these devices are as follows. U.S. Pat. No. 4,002,893 to Newcomb et al, dated Jan. 11, 1977, discloses a ball having a translucent plastic skin and an internal electrically operated illumination system. U.S. Pat. No. 4,479,649 to Newcomb et al, dated Oct. 30, 1984, discloses a ball having an inflatable, translucent skin. At one end an apertured fitting allows for insertion of an activated chemical light stick, while the opposite end has an inflation fitting. As the ball inflates, the apertured fitting tightens around the chemical light stick, resulting in an air tight seal. To remove the chemical light stick, the ball must be deflated. Finally, U.S. Pat. No. 4,717,158 to Pennisi, dated Jan. 5, 1988, which is considered to be the closest known prior art, discloses a footbag that is constructed of soft translucent plastic filled with fluorescent pellets. A hole is provided in the plastic skin for inserting an activated chemical light stick thereinto. A plurality of holes are provided in the plastic skin to assure an inelastic interface with any surfaces it may contact.

The prior art fails to adequately address the continuing need in the art to provide a footbag which permits easy insertion and removal of a light emitting device. U.S. Pat. No. 4,002,839 requires batteries which are notoriously heavy. U.S. Pat. No. 4,479,649 is too complicated in that it must be inflated each time a new chemical light stick is used; further it is ill-suited to use as a footbag. Finally, U.S. Pat. No. 4,717,158 is impractical in operation, in that there is no apparent provision for retrieval of the chemical light stick once it has been placed therein.

Clearly, therefore, what is needed is a footbag incorporating a simple and effective means to removably interconnect with a chemical light stick.

SUMMARY OF THE INVENTION

The present invention is a footbag having a pliant outer skin made of a translucent plastic material. It is preferred that the skin be stitched together in a manner common in conventional leather skinned footbags. The interior of the footbag is filled with a plurality of translucent or fluorescent beads. An aperture is provided in the skin, the diameter of which permitting at least one chemical light stick to be inserted into the footbag. Connected with the skin adjacent the aperture therein, and extending into the interior of the foot bag is a sack of generally cylindrical shape. The sack is translucent and receives the one or more chemical light sticks so that the beads are prevented from spilling out of the foot bag through the aperture. A partially attached flexible skin panel covers the aperture, and is permanently secured to the skin at a portion of the perimeter of the aperture, in those areas where it is not so secured, a hook and loop type fastener attaches the flexible skin panel to the skin along the remainder of the perimeter.

Accordingly, it is an object of the present invention to provide a footbag having an internal illumination system in which at least one chemical light stick may be removably interconnected within the footbag.

It is yet an additional object of the present invention to provide a footbag having an interior sack for receiving a chemical light stick, in which the sack permits light from the light stick to emanate out of the sack, but does not allow beads within the footbag to escape.

It is yet a further object of the present invention to provide a flexible skin panel selectively attached to the skin of a footbag so that the flexible skin panel may selectively cover an aperture in the skin used for placement of a chemical light stick within the footbag.

It is still another object of the present invention to provide a flexible plastic skin for a footbag in which the skin is stitched together in a manner commonly used with respect to conventional leather skinned footbags.

These, and additional objects, advantages, features and benefits of the present invention will become apparent from the following specification.

DETAILED DESCRIPTION OF THE PREFERRED EMBODIMENT

Figure 1:
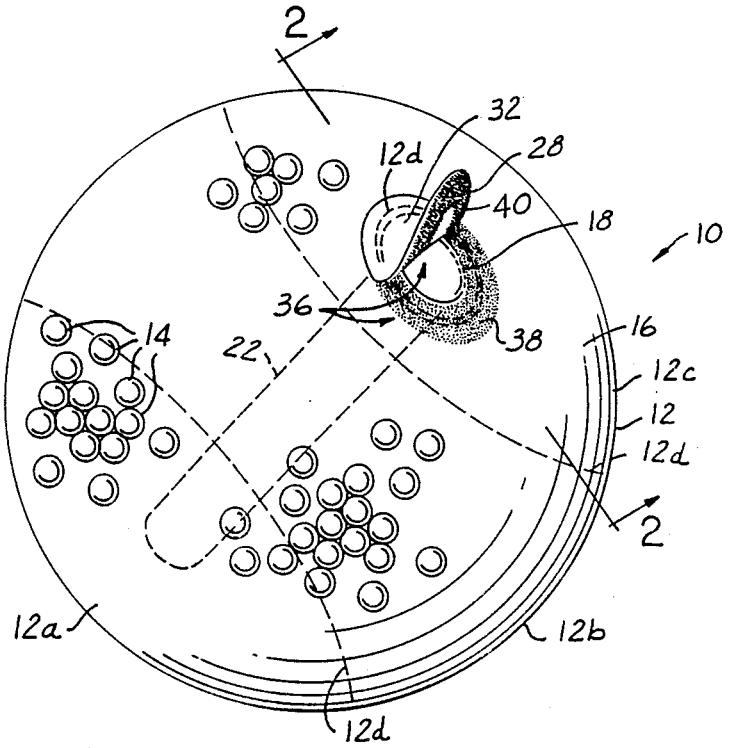
FIG. 1 is a perspective view of a footbag according to the present invention.
Figure 3:
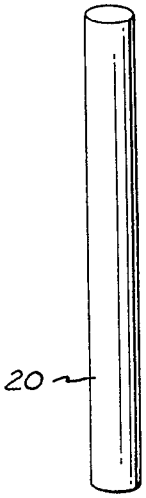
FIG. 3 is a side view of a conventional chemical light stick which is used in combination with the footbag according to the present invention.

Referring now to the Drawing, FIG. 1 shows generally the footbag 10 according to the present invention. The footbag 10 is defined by a skin 12 which is constructed of a translucent, pliable, soft plastic material having a generally spherical shape. The skin 12 may be of singular construction; however, it is preferred that the skin be constructed of multiple pieces **12*a*, 12*b*, and 12*c* which are connected together by stitches 12*d* in the manner commonly used with respect to conventional leather skinned footbags. Within the skin 12 is a plurality of beads 14 that essentially fill the interior space 16 defined by the skin 12. An aperture 18 is provided in the skin 12 for purposes of inserting thereinto at least one conventional chemical light stick 20, two chemical lights sticks being shown inserted in FIG. 3. An interior sack 22 is connected with the skin 12 at the perimeter 26 of the aperture 18. The sack 22 is structured to receive the chemical light stick, let light from the chemical light stick transmit therethrough, but not allow the beads out the aperture 18. The sack may be clear, colored or fluorescent. A flexible skin panel 28 is provided which selectively covers the aperture 18**.

The footbag 10 is preferred to be dimensioned in accord with conventional footbag balls, and is also preferred to have the pliancy and resiliency characteristics of such balls, as well. In order to provide these characteristics, the skin 12 is preferred to be constructed of a thin, soft plastic film material. Where the skin 12 is of singular construction, pliancy may be accomplished by providing one or more air vent holes in the skin, as shown in the above referenced prior art; but vents are not essential and can be omitted, if desired. Pliancy can also be achieved by allowing the skin to breath through the interior sack 22 and then out the aperture 18, as will be discussed in detail below. In any event, where the skin 12 is of multi-part construction, the stitched areas will allow breathing so as to provide pliancy in a manner very similar to that of conventional multi-part stitched leather footbags. Resiliency should be similar to that of conventional footbag balls in that a large number of beads 14 are provided internal to the skin 12; thus, the footbag 10 according to the present invention should, since the skin is pliant and the beads retained in a fluid state, not bounce, or at least not bounce appreciably, upon impact.

The skin 12 further has the property of permitting light to transmit therethrough. The skin may be clear, colored, or fluorescent. A high level of light transmissability is desired.

The aperture 18 is provided on the skin 12 so that at least one conventional chemical light stick 20 may be temporarily inserted therethrough into the footbag 10 during play in dim light or darkness. In order that the beads 14 not be able to escape and further that the chemical light stick 20 be retained in a definitely defined space within the footbag 10, the internal sack 22 is provided to receive the chemical light stick 20 when it is resident within the footbag 10. The internal sack 22 is dimensioned so that it may easily receive one chemical light stick, or optionally, one or more chemical light sticks, and is attached to the skin 12 at the perimeter 26 of the aperture 18. The internal sack may or may not be integral with the skin; if not, it is secured to the skin in any conventional manner known to the artisan, such as by sonic welding. Importantly, the internal sack is constructed of a light transmissive material, preferably either identical with the skin material or any clear pliant plastic.

Beads 14 are provided in the space between the skin 12 and the internal sack 22 in a number sufficient to fill the volume of the space, but not so full as to degrade the aforementioned resiliency characteristic desired of the footbag. Each bead is light transmissive, and may be clear or be of various combinations of colors, one color, or fluorescent. Each bead is preferred to be relatively very small compared to the size of the footbag 10; for example, beads on the order of one-sixteenth inch could be used.

As mentioned above, it is desired that the pliancy characteristics be as closely duplicated with those of conventional footbags. This can be attained by providing small air holes 30 in the wall of the interior sack 22, each air hole 30 being smaller than the diameter of the smallest bead 14.

Figure 2:
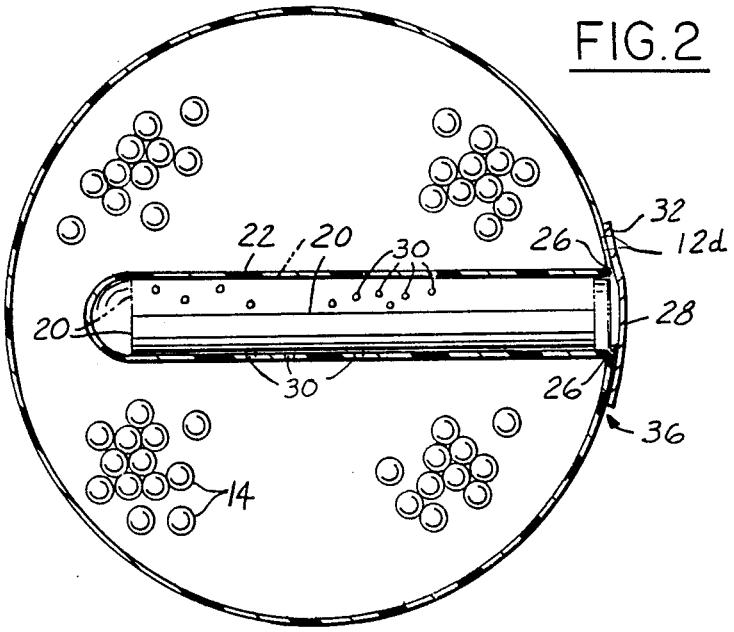
FIG. 2 is a sectional side view of the footbag according to the present invention as seen along lines 2—2 in FIG. 1, in which a conventional chemical light stick is placed within the footbag.

A portion 32 of the flexible skin panel 28 is attached permanently to the skin 12 at a location immediately adjacent the aperture 18. Attachment may be by stitches, as shown in FIG. 2, by sonic welding or other attachment means known to the artisan. The remaining portion of the flexible skin panel 28 which contacts the skin 12 when it lies flat thereon is releasably attached to the skin by operation of a hook and loop type fastener 36, such as VELCRO, a registered trademark of Velcro U.S.A., Inc. This is accomplished by the hook portion 38 being attached, preferably by stitching, to one of the skin 12 or the flexible skin panel 28, and the loop portion 40 being similarly attached to the other of the skin 12 and the flexible skin panel 28.

In operation, the footbag 10 is played until darkness becomes an adverse factor of play. Thereupon, the flexible skin panel is pulled back as shown in FIG. 1, so that a conventional chemical light stick, of the kind for instance known as LUNKER LIGHTS, a trademark of American Cyanamid Corporation, may be inserted. After activating the chemical light stick, the chemical light stick is inserted through the aperture 18 into the interior sack, then the flexible skin panel is pressed onto the skin to activate the hook and loop fastener. Now light will transmit from the chemical light stick, beautifully through the beads and through the skin 12. During play, the footbag 10 may be easily discerned no matter what level of darkness pervades. Air moving through the air holes in the interior sack and, connectively out and in though the space between the flexible skin panel and the skin, allows for the desired degree of pliancy of the footbag 10 that was discussed above.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A toy ball for use in combination with at least one chemical light stick, said toy ball comprising:

a skin, said skin being pliant and light transmissible, said skin defining an interior space, said skin having an aperture, said aperture having a perimeter;

an interior sack located inside said skin, said interior sack being connected with said skin at the perimeter of said aperture, said interior sack being light transmissible, said aperture in said skin and said interior sack being dimensioned to permit said at least one chemical light stick to be fully inserted thereinto;

a plurality of light transmissible beads filling said interior space between said skin and said interior sack;

ventilation means connected with at least one of said skin and said interior sack for providing ventilation of said interior space; and retaining means connected with said skin for releasably holding said at least one chemical light stick in said interior sack.

2. The toy ball of claim 1, wherein said retaining means further comprises:

a flexible skin panel; and a hook and loop fastener means connected with said flexible panel and said skin for at least in part attaching said flexible skin panel to said skin.

3. The toy ball of claim 2, wherein said ventilation means comprises said interior sack having at least one ventilation hole therein; said ventilation means further comprising vent means associated with said perimeter of said aperture and said retaining means for venting air with respect to said interior space, said at least one ventilation hole being smaller in cross-section than that of each bead of said plurality of beads.

4. The toy ball of claim 2, wherein said skin is comprised of at least two skin pieces that are stitched together to form said skin.

5. The toy ball of claim 4, wherein said interior sack further has at least one air hole therein, said at least one air hole being smaller in cross-section than that of each bead of said plurality of beads.

6. A footbag for use in combination with at least one chemical light stick, said footbag comprising:

a skin, said skin being pliant and light transmissible, said skin defining an interior space, said skin having an aperture, said aperture having a perimeter;

an interior sack located inside said skin, said interior sack being connected with said skin at the perimeter of said aperture, said interior sack being light transmissible, said aperture in said skin and said interior sack being dimensioned to permit said at least one chemical light stick to be fully inserted thereinto;

a plurality of light transmissible beads filling said interior space between said skin and said interior sack;

ventilation means connected with at least one of said skin and said interior sack for providing ventilation of said interior space;

flexible skin panel means connected with said skin for releasably holding said at least one chemical light stick in said toy ball after being fully inserted into said interior sack; and a hook and loop fastener means connected with said flexible skin panel means and said skin for at least in part attaching said flexible skin panel to said skin.

7. The toy ball of claim 6, wherein said ventilation means comprises said interior sack having at least one ventilation hole therein; said ventilation means further comprising vent means associated with said perimeter of said aperture and said retaining means for venting air with respect to said interior space, said at least one ventilation hole being smaller in cross-section than that of each bead of said plurality of beads.

8. The toy ball of claim 6, wherein said skin in comprised of at least two skin pieces that are stitched together to form said skin.

9. The toy ball of claim 8, wherein said ventilation means comprises said interior sack having at least one ventilation hole therein; said ventilation means further comprising vent means associated with said perimeter of said aperture and said retaining means for venting air with respect to said interior space, said at least one ventilation hole being smaller in cross-section than that of each bead of said plurality of beads.

* * * * *